US005263543A

United States Patent [19]

Nigro

[11] Patent Number: 5,263,543

[45] Date of Patent: Nov. 23, 1993

[54] EXTERNAL FIRE PREVENTION SYSTEM

[76] Inventor: Ralph Nigro, 5875 Mosher Rd., Mariposa, Calif. 95338

[21] Appl. No.: 276,023

[22] Filed: Nov. 25, 1988

[51] Int. Cl.[5] ..... A62C 37/40

[52] U.S. Cl. ..... 169/56; 169/16; 169/61

[58] Field of Search ..... 169/48, 45, 61, 54, 169/70, 16, 56, 60

[56] References Cited

U.S. PATENT DOCUMENTS

| | | | |
|---|---|---|---|
| 2,337,710 | 12/1943 | Cowan | 169/48 X |
| 2,413,087 | 12/1946 | Urbany | 169/61 |
| 2,509,497 | 5/1950 | Hesson | 169/61 |
| 3,583,490 | 6/1971 | McFadden | 169/60 |
| 3,754,600 | 8/1973 | Miller | 169/45 |
| 3,766,958 | 10/1973 | Mitchell | 169/48 X |
| 4,091,876 | 5/1978 | Valdatta | 169/62 |
| 4,691,783 | 9/1987 | Stern et al. | 169/61 |
| 4,836,290 | 6/1989 | Le Lande, Jr. | 169/54 X |

*Primary Examiner*—David M. Mitchell
*Assistant Examiner*—Andrew C. Pike
*Attorney, Agent, or Firm*—Roger A. Marrs

[57] ABSTRACT

A fire prevention system is disclosed herein for external installation on a dwelling having an extended conduit closed at one end and detachably coupled to a source of pressurized water at its opposite end. A portion of the conduit is disposed along the highest part of the roof and is provided with a plurality of spaced-apart fluid discharge nozzles such as sprinklers. A smoke detector and sprinkler activator is operably connected to the conduit and is critically mounted on the exterior of the dwelling on the side thereof most likely to detect the presence of smoke. The windward side is an example. The activator includes solenoid operated valves responsive to the detector and further, a deactivate circuit is operably included for automatic shut-off.

1 Claim, 1 Drawing Sheet

EXTERNAL FIRE PREVENTION SYSTEM

BACKGROUND OF THE INVENTION

1. Field of the Invention

The present invention relates to fire prevention systems and more particularly to a novel sprinkler fire prevention system extending across the top of a roof and having a smoke detector control box externally mounted for controlling the supply of water to the sprinklers and for automatically turning the supply off.

2. Brief Description of the Prior Art

In the past, it has been the conventional practice to employ a variety of water systems for controlling fires which frequently occur on a dwelling or building. Usually, the sprinkler systems are extended across the roof and are activated by manually turning valves to supply the sprinklers with a pressurized source of water. In some instances, the valves are connected to an automatic fire detection system which is internally mounted in the dwelling and that senses a combustible condition which then automatically operates the valves.

Although these prior systems have been successful for their intended purposes, it is noted that the systems are internally located in the dwelling or building and that the sensing is achieved only when a combustible condition is present. These prior systems operate upon the detection of heat through temperature sensing. Although smoke detectors are available, the smoke detectors are generally used in connection with alarms that are either visual or audible and do not control sprinkler or water systems.

Therefore, a long standing need has existed to provide a novel fire prevention system that senses external fire conditions such as the presence of smoke, and which, when so sensed or detected, will automatically activate a sprinkler system, and when the presence of the smoke has disappeared, will automatically deactivate the system.

SUMMARY OF THE INVENTION

Accordingly, the above problems and difficulties are obviated by the present invention which provides a novel fire prevention system wherein a plurality of sprinklers are located in spaced-apart relationship along a water supply conduit along the top of a roof carried on a building or dwelling. The water conduit is placed in series with a control box which includes solenoid-operated valves for activating and deactivating the system in response to the detection of smoke via a smoke detector. The control box is strategically located external of the building structure and is critically located in a favored position such as to windward so that smoke will be sensed before actual fire reaches the dwelling.

Therefore, it is among the primary objects of the present invention to provide a novel fire prevention system which will sense the presence of smoke before a combustible condition occurs so that a sprinkler system can be automatically activated.

Another object of the present invention is to provide an inexpensive fire prevention system mountable on rooftops, which includes a control means for activating and deactivating a source of pressurized water to the system that is responsive to the presence of smoke exteriorly of a dwelling or building.

Yet another object of the present invention is to provide a novel fire prevention system for automatically activating and deactivating in response to the detection of smoke.

BRIEF DESCRIPTION OF THE DRAWINGS

The features of the present invention which are believed to be novel are set forth with particularity in the appended claims. The present invention, both as to its organization and manner of operation, together with further objects and advantages thereof, may best be understood with reference to the following description, taken in connection with the accompanying drawings in which:

DESCRIPTION OF THE PREFERRED EMBODIMENT

Figure 1:
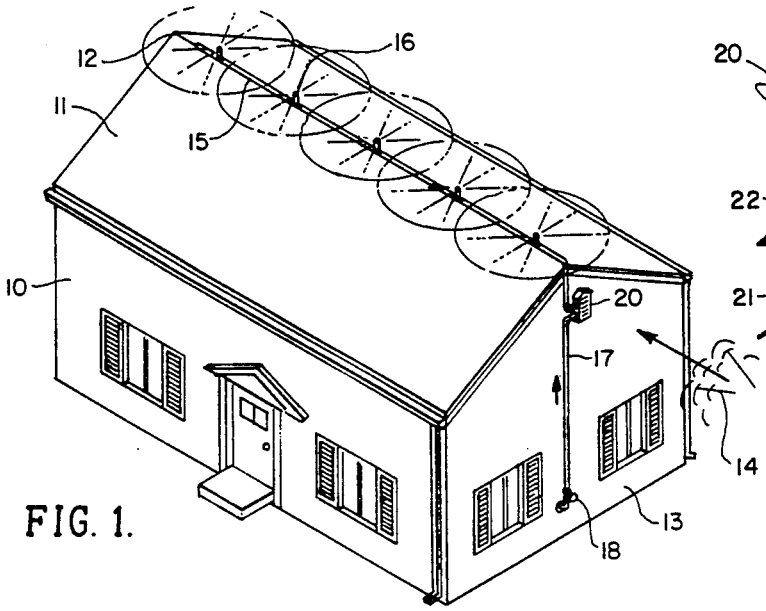
FIG. 1 is a front perspective view of a dwelling illustrating the novel fire prevention system in a typical installation in accordance with the present invention.

Referring to FIG. 1, a building structure or dwelling is illustrated by the numeral 10 which includes a roof 11 having a peak 12 and a building side 13 which faces the wind as indicated by the numeral 14. The novel fire prevention system incorporating the present invention includes an elongated conduit 15 which is carried on the peak 12 and is provided with a plurality of sprinklers, such as sprinkler 16, arranged in fixed spaced-apart relationship along the entire length of the conduit. Conduit 15 is supplied with pressurized water from a feeder pipe or conduit 17, which includes a shut-off valve 18 that may be manually manipulated at the discretion of the user. Along the selected side 13 of the building, the conduit 17 is interrupted by a control means 20 which includes a smoke detector and solenoid-operated valve for automatically opening and closing the water conduit 17. It is to be particularly noted that the control means 20 is critically located on the windward side of the building structure so that any smoke, such as represented by numeral 14, will be detected by the smoke sensor and automatically activate the sprinkler system. Furthermore, when there is an absence of smoke in the presence of the control means 20, the sprinkler system will be automatically deactivated.

When the sprinkler system is activated, water will be distributed about the roof 11 to substantially cool the building structure and avoid a combustion or ignition situation in the event sparks or other burning material should come in contact with the structure. It is to be particularly noted that the control means 20 will be activated in advance of any combustion within or on the building 10, which is a major feature of the present invention.

Figure 2:
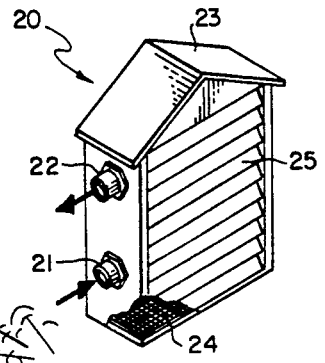
FIG. 2 is an enlarged perspective view of the control means incorporated in the fire prevention system shown in FIG. 1.

Referring to FIG. 2, the control means is illustrated as being a housing having an input port 21 for connection directly to the conduit or pipe 17 and an exit port 22 for coupling directly to the conduit 15 for distributing water to the sprinklers 16. Preferably, the control means is a housing having a slanted or peaked roof 23 so that rain, snow, dirt or the like will not collect or influence the operation of the control means. The bottom of the housing is provided with a screen 24 through which smoke or the like will enter the interior for detection. Also, a plurality of louvres 25 are provided along one side of the housing to again permit smoke to enter.

Figure 3:
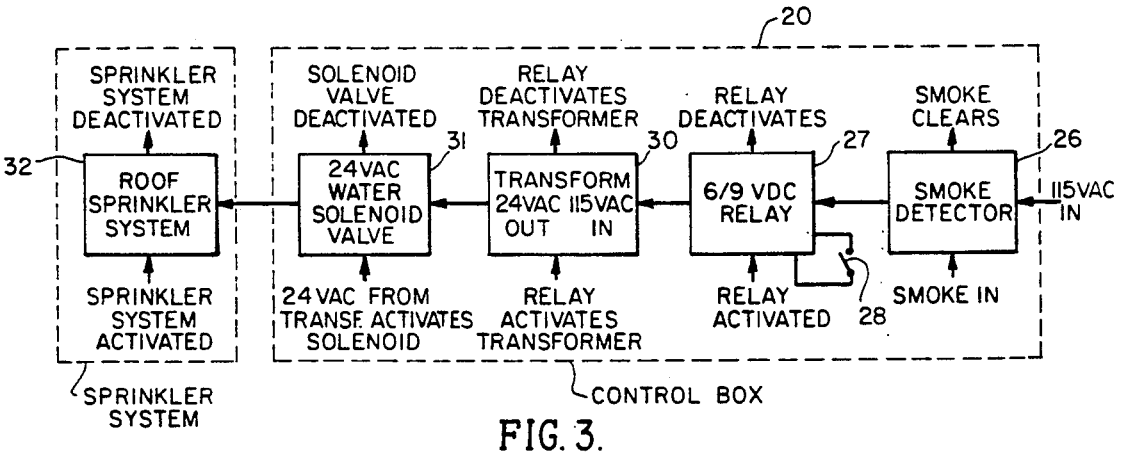
FIG. 3 is a block diagram illustrating the components of the control means housed in the control box shown in FIG. 2.

Referring now in detail to FIG. 3, it can be seen that the control means 20 includes a smoke detector 26 which provides a signal to a relay 27 that closes when activated. The relay includes a manual override switch 28 so that the system can be manually deactivated when it is no longer needed to be placed in operation. When the relay is actuated, the signal is supplied to the transformer 30 which operably couples with the solenoid valve 31. The transformer supplies 24 volts of alternating current to the solenoid for valve actuation. Upon actuation, the roof sprinkler system, indicated by numeral 32, will be activated.

Figure 4:
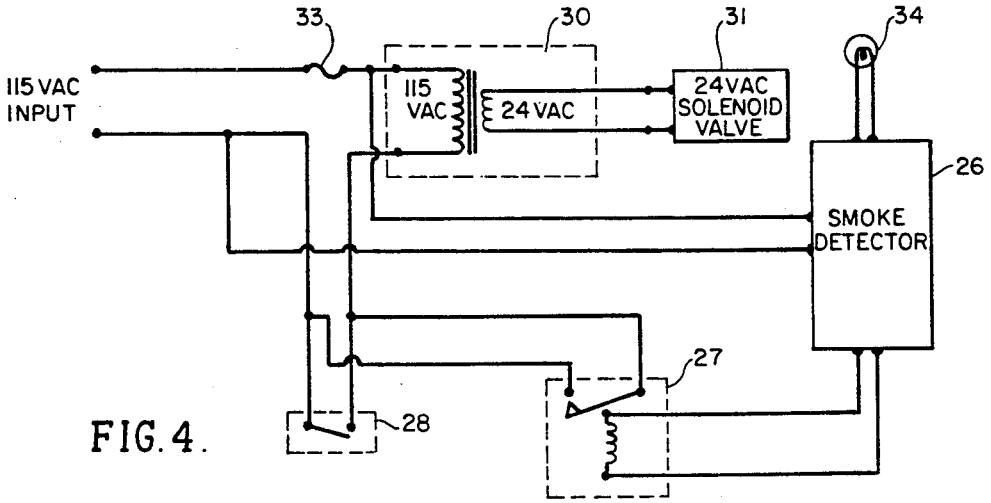
FIG. 4 is a schematic drawing of the circuit illustrated in block form in FIG. 3.

Referring to FIG. 4, a schematic for the circuit described with respect to the block diagram of FIG. 3 is illustrated. The system is protected by fuse 33 and an actuation light 34 is incorporated into the smoke detector 26 circuit to show that the system is armed.

Therefore, in view of the foregoing, it can be seen that the fire prevention system of the present invention senses smoke before the structure is ignited and that the system may also be used by manual operation. In actual operation, the sprinkler system is installed on the peak of the roof and the water input is controlled by the control means 20 mounted on the windward side of the house near the roof. In most instances, the favored mounting will be on the northeast side of the house. When the control means senses smoke by the smoke detector, it will automatically activate a water solenoid valve 31, which will release water onto the roof via the plurality of sprinklers 16. The water will continue to flow through the sprinklers 16 as long as smoke is sensed by the smoke detector and smoke is in the area. When the smoke has cleared up, the control means will automatically deactivate the water solenoid valve and stop the flow of water. The system will then be on guard and ready for operation.

While particular embodiments of the present invention have been shown and described, it will be obvious to those skilled in the art that changes and modifications may be made without departing from this invention in its broader aspects and, therefore, the aim in the appended claims is to cover all such changes and modifications as fall within the true spirit and scope of this invention.

What is claimed is:

1. A fire prevention system responsive to ambient smoke presence prior to building ignition comprising the combination of:

a structural building having a strategic selected side facing windward and an elevated roof partially supported by said selected side;

a sprinkler system mounted on said building roof adapted to distribute water over said roof;

a source of pressurized water operably coupled to said sprinkler system;

control means mounted externally of said building interconnecting said water source to said sprinkler system operable in response to the presence of ambient smoke external of said building to actuate said sprinkler system;

said control means includes a smoke detector external of said building critically disposed adjacent said selected building side facing windward and a solenoid-operated valve actuated in response to said smoke detector to connect said water supply to said sprinkler system;

said control means includes a deactivation circuit for disconnecting said water supply from said sprinkler system in response to the absence of smoke via said solenoid-operated valve;

manual switch means coupled to said activation circuit for overriding said control means to effect manual operation of said solenoid-operated valve; and said control means including said solenoid-operated valve critically located on said external side of said building facing windward in order to be sensitive to ambient wind carrying smoke generated from other than said building.

* * * * *